US007168385B1

(12) United States Patent
Thomas

(10) Patent No.: US 7,168,385 B1
(45) Date of Patent: Jan. 30, 2007

(54) WATERCRAFT TETHERING APPARATUS

(76) Inventor: Paul C. Thomas, 35679 W. Island Dr., Eastlake, OH (US) 44095

( * ) Notice: Subject to any disclaimer, the term of this patent is extended or adjusted under 35 U.S.C. 154(b) by 0 days.

(21) Appl. No.: 10/974,520

(22) Filed: Oct. 27, 2004

Related U.S. Application Data

(60) Provisional application No. 60/515,006, filed on Oct. 28, 2003.

(51) Int. Cl.
*B63B 21/00* (2006.01)

(52) U.S. Cl. ..... 114/230.23; 114/230.26; 242/371; 242/377; 242/379

(58) Field of Classification Search ..... 114/230.1, 114/230.23, 230.24, 230.25, 230.26, 230.29, 114/230.3; 242/371–377, 379, 379.1, 379.2; 24/17 A, 16 PB
See application file for complete search history.

(56) References Cited

U.S. PATENT DOCUMENTS 2,423,818 A * 7/1947 Schmutzler ..... 40/662
3,851,613 A * 12/1974 Armour ..... 114/230.23
4,697,537 A * 10/1987 Smith ..... 114/230.23
4,846,090 A * 7/1989 Palmquist ..... 114/230.23
5,134,964 A * 8/1992 Masters ..... 114/347
5,292,089 A * 3/1994 Whitman et al. ..... 244/115
5,365,872 A 11/1994 Obrinski
5,482,258 A 1/1996 Clauson
5,581,850 A * 12/1996 Acker ..... 24/16 PB
5,819,679 A 10/1998 Bonate et al.
6,095,075 A 8/2000 Gordon et al.
6,182,592 B1 2/2001 Molz

* cited by examiner

*Primary Examiner*—Sherman Basinger
(74) *Attorney, Agent, or Firm*—Pearne & Gordon LLP

(57) ABSTRACT

A tethering apparatus for a watercraft includes an elongated flexible line, a spool and a biasing member adapted to urge the spool to automatically uptake portions of the elongated flexible line. A locking device is attached to an end portion of the elongated flexible line to assist in tethering the watercraft to a mooring structure.

23 Claims, 11 Drawing Sheets

WATERCRAFT TETHERING APPARATUS

CROSS-REFERENCE TO RELATED APPLICATIONS

This application claims the benefit of U.S. Provisional Application No. 60/515,006 filed on Oct. 28, 2003, which is entirely incorporated herein by reference.

FIELD OF THE INVENTION

The present invention is directed apparatus for tethering a watercraft and more particularly to an apparatus for tethering a personal watercraft including an elongated flexible line and a biasing member adapted to automatically uptake portions of the elongated flexible line.

BACKGROUND OF THE INVENTION

To safely moor a watercraft to docks, piers, trees, or other mooring structures, it is known to provide a watercraft with a mooring rope to enable the watercraft to be secured to and maintained near a landing area such as a pier, dock, etc. For example, it is known to dock a watercraft by positioning the watercraft near the landing area and remove mooring lines from a storage compartment on the watercraft and thereafter lash the mooring line to a cleat on the watercraft and the mooring structure on the landing. However, providing a separate mooring line that is stored by the user can result in tangling and might occupy space that can be used for other items. In addition, conventional mooring lines may not easily tie to various mooring structures. For example, a tree or post might require excessive mooring line to form complicated lashings and/or knots. Requiring additional mooring line to accommodate various mooring structures further depletes available storage space on the watercraft.

In addition, smaller watercraft, such as personal watercraft, also known as "PWC", may not include a tethering line and might have very limited, if any, storage space for items such as a bulky mooring line. In addition, many personal watercraft do not include a cleat typical of larger watercraft due to safety concerns. Indeed, a protruding cleat may cause a hazard to riders of the personal watercraft who frequently fall off the personal watercraft during use.

It is known to tether a line to the handlebars of the personal watercraft, to overcome the need for providing a separate cleat arrangement. In an attempt to avoid contact with a rider potentially falling off the personal watercraft, it is also known to provide a cleat arrangement in the front of the personal watercraft wherein tethering line is stored in a front compartment of the personal watercraft. However, due to the inherent instability of personal watercraft, it is difficult to reach over the handlebars to remove the line from the front compartment and tie the line to the cleat. The rider of the personal watercraft is often required to enter the water to appropriately tie the tethering line to the cleat at the front end of the personal watercraft to avoid falling into the water. It is also known to tie the tethering line to the front cleat prior to launching the personal watercraft into the water. However, the line must be draped over the front hood of the personal watercraft with the remainder stored in the compartment in use. Storing the line in this manner exposes a portion of the line which might be snagged by objects and can create a further hazard for riders that might become tangled in the line in use.

Accordingly, there is a continuing need for additional watercraft mooring structures that conveniently store mooring line when not in use and provide enhanced mooring features. More particularly, there is a continuing need for providing a personal watercraft with an apparatus for tethering that reduces hazardous conditions to the rider while providing convenience during the mooring process.

SUMMARY OF THE INVENTION

In accordance with one aspect, the present invention an apparatus is provided for tethering a watercraft having a wall with an exterior surface and an interior surface. The apparatus includes a first housing adapted to be mounted with respect to the exterior surface of the watercraft. The first housing includes an outer surface and an abutment surface adapted to be positioned adjacent the exterior surface of the watercraft. The first housing further comprises a countersunk aperture including a passage and a countersunk recess in communication with the passage, wherein the countersunk recess is enlarged with respect to the passage. The apparatus further includes a second housing including an interior area, wherein the second housing is adapted to be mounted with respect to the interior surface of the watercraft. Still further, the apparatus includes an elongated flexible line threaded through the passage of the first housing and including a first end portion and a second end portion. A spool is rotatably mounted within the interior area of the second housing wherein the first end portion of the elongated flexible line is attached to the spool. The apparatus also includes a biasing member adapted to urge the spool to automatically uptake portions of the elongated flexible line. A locking device is attached to the second end portion of the elongated flexible line and is at least partially positioned within the countersunk recess of the countersunk aperture. The locking device and the passage of the countersunk aperture are configured to limit automatic uptake of portions of the elongated flexible line. The biasing member is adapted to urge the locking device to be at least partially positioned within the countersunk recess. The locking device is adapted to be pulled from the countersunk recess and thereafter engaged with an intermediate portion of the elongated flexible line to form a mooring loop.

In accordance with another aspect of the present invention, an apparatus is provided for tethering a watercraft having a wall with an exterior surface and an interior surface. The apparatus includes a first housing adapted to be mounted with respect to the exterior surface of the watercraft. The first housing includes an outer surface and an abutment surface adapted to be positioned adjacent the exterior surface of the watercraft. The first housing further comprises a countersunk aperture including a passage and a countersunk recess enlarged with respect to the passage and in communication with the passage. A structure of the first housing forms the countersunk recess and includes at least a portion of the abutment surface. A second housing includes an interior area, wherein the second housing is adapted to be mounted with respect to the interior surface of the watercraft. An elongated flexible line is threaded through the passage of the first housing and includes a first end portion and a second end portion. A spool is rotatably mounted within the interior area of the second housing. The first end portion of the elongated flexible line is attached to the spool. A biasing member is adapted to urge the spool to automatically uptake portions of the elongated flexible line. A stop member attached to the second end portion of the elongated flexible line and at least partially positioned within the countersunk recess of the countersunk aperture, the stop member and the passage of the countersunk aperture being configured to limit automatic uptake of portions of the elongated flexible line, wherein the biasing member is adapted to urge the stop member to be at least partially positioned within the countersunk recess.

In accordance with a further aspect of the present invention, an apparatus is provided for tethering a watercraft. The apparatus includes a housing with an interior area and an elongated flexible strap including a plurality of apertures, a first end and a second end. A spool is rotatably mounted within the interior area of the second housing and the first end of the elongated flexible strap is attached to the spool. A biasing member is adapted to urge the spool to automatically uptake portions of the elongated flexible strap and an interlock device attached to the second end of the elongated flexible line. The interlock device is adapted to releasably interlock with a selected one of the apertures to form a mooring loop having a predetermined size.

In accordance with another aspect of the present invention, an apparatus for tethering a watercraft is provided. The apparatus includes a housing with an interior area and an elongated flexible line including a first end portion and a second end portion extending along an elongated axis. A spool is rotatably mounted within the interior area of the second housing with the first end portion of the elongated flexible line being attached to the spool. A biasing member is adapted to urge the spool to automatically uptake portions of the elongated flexible line and a locking device is attached to the second end portion of the elongated flexible line. The locking device includes an elongated locking member including a width and an elongated length that is greater than the width. The elongated length extends generally transverse with respect to the elongated axis of the second end portion of the elongated flexible line.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DETAILED DESCRIPTION OF EXAMPLE EMBODIMENTS

Figure 1:
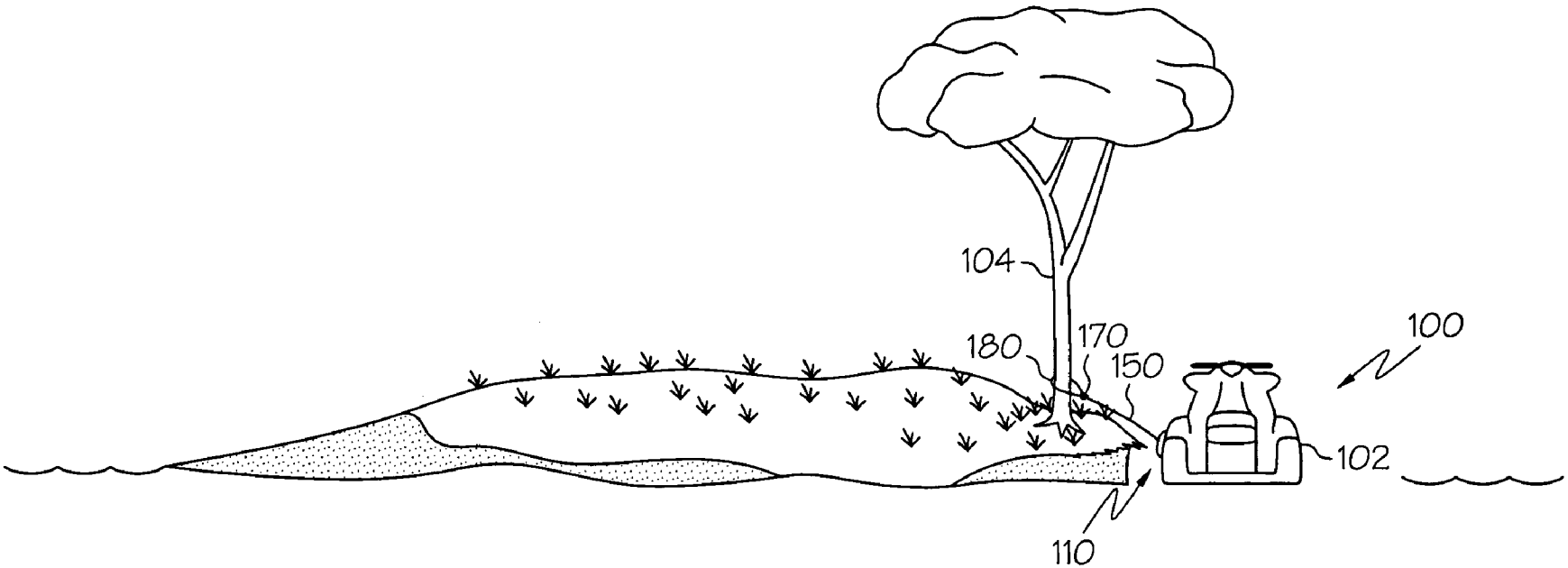
FIG. 1 depicts a personal watercraft with an apparatus tethering the personal watercraft to a mooring structure.

Certain terminology is used herein for convenience only and is not to be taken as a limitation on the present invention. Further, in the drawings, the same reference numerals are employed for designating the same elements, and in order to clearly and concisely illustrate the present invention, certain features may be shown in somewhat schematic form.

FIG. 1 depicts a view of a personal watercraft 100, commonly sold as Jet Ski personal watercraft. The personal watercraft 100 can be of a stand-up type with a platform for standing and/or a sit-down type, for example, with a seat to straddle. Each version of the personal watercraft includes a steering device, such as handlebars for maneuvering the personal watercraft while riding on the surface of the water. A personal watercraft commonly includes an engine, such as a combustion engine, for powering the personal watercraft. As shown in FIG. 1, the personal watercraft 100 in accordance with the present invention include an apparatus 110 for tethering the watercraft to a mooring structure 104, such as a tree trunk. In exemplary embodiments, the tethering apparatus 110 can include an elongated flexible line 150 and a stop member to limit uptake of the elongated flexible line. In particular embodiments, the stop member comprises a locking device 170 for engaging an intermediate portion of the elongated flexible line 150 to form a mooring loop 180.

The tethering apparatus 110 finds particular application in the field of personal watercraft due to the inherent instability of personal watercraft. Indeed, the inherent instability of personal watercraft complicates retrieval of a tethering line from distant storage compartments for mooring the personal watercraft. It is also difficult for the rider sitting or standing on the personal watercraft to lash the line to a cleat, if provided, prior to dismounting the personal watercraft. The tethering apparatus 110 of the present invention can be conveniently located on a wall 102 of the personal watercraft at a convenient location where a rider may access the tethering apparatus just prior to, or during, dismounting of the personal watercraft. Due to the convenient nature of the tethering apparatus 110, the line may be automatically stored and deployed as necessary. Moreover, conventional cleats are not required, thereby reducing the possibility of injury to the rider.

While the tethering apparatus 110 of the present invention is discussed with particular application to personal watercraft, it is understood that tethering apparatus 110 might also be used with other watercraft such as row boats, powered boats with inboard and/or outboard engines, etc. Moreover, while a single tethering apparatus 110 is disclosed, it is understood that certain applications might incorporate a plurality of tethering apparatus in accordance with concepts of the present invention.

Figure 2:
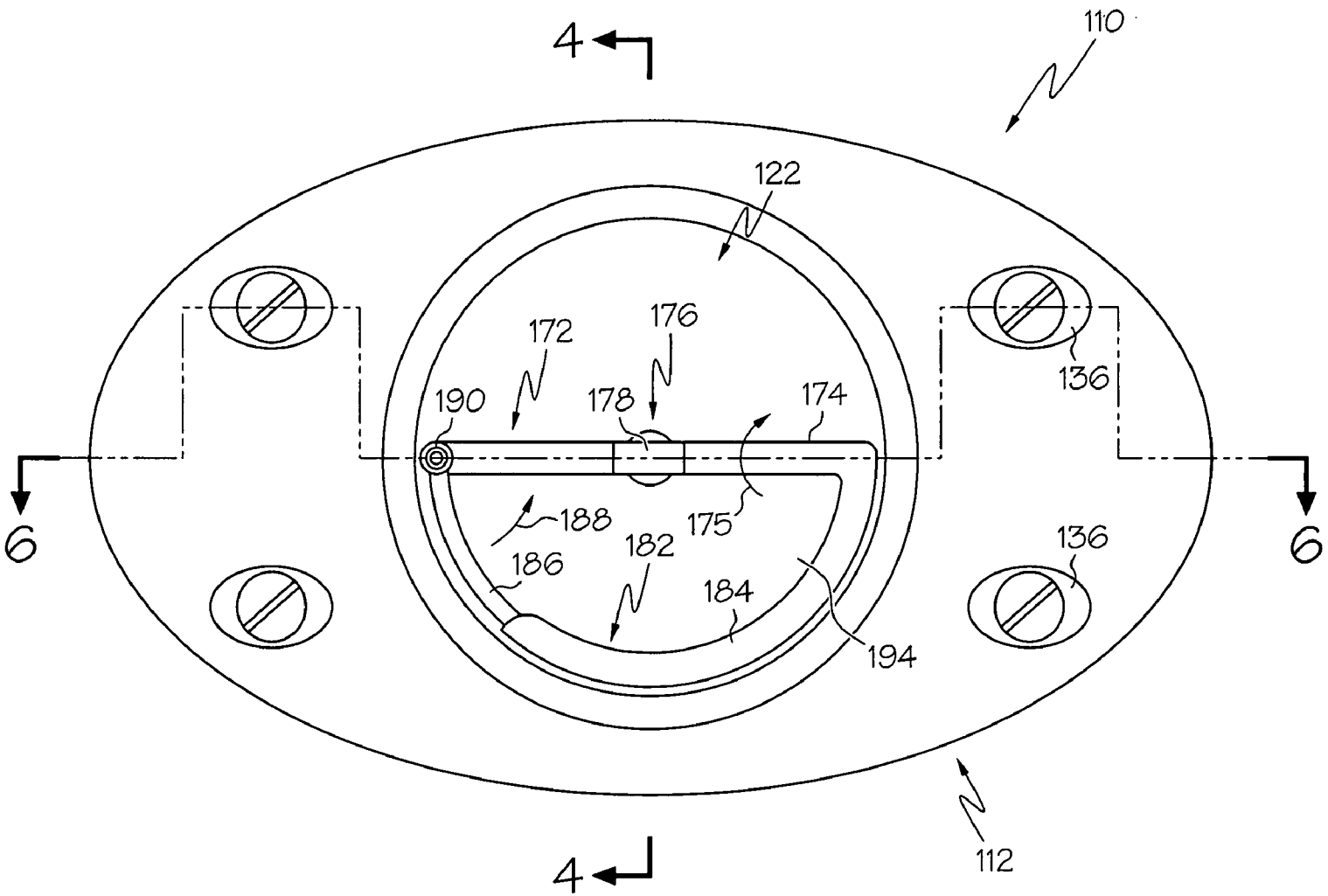
FIG. 2 is a front elevational view of an apparatus for tethering a watercraft in accordance with an embodiment of the present invention including a locking device in accordance with a first embodiment of the present invention.
Figure 3:
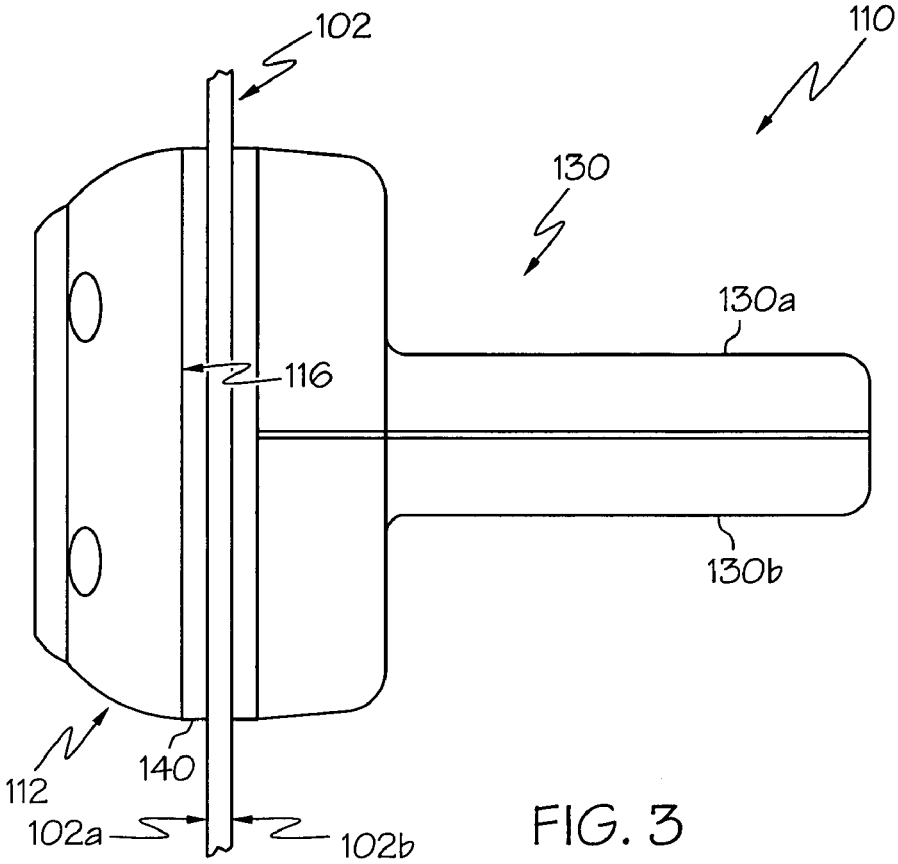
FIG. 3 is a right side elevational view of the apparatus for tethering a watercraft of FIG. 2.

Details of one exemplary embodiment of a tethering apparatus 110 is illustrated in FIGS. 2–6. As shown in FIG. 2, the tethering apparatus 110 includes a first housing 112. As shown in FIG. 3, the first housing 112 is adapted to be mounted with respect to the wall 102 of the personal watercraft 100. In particular, the first housing 112 includes an abutment surface 116 adapted to be positioned adjacent an exterior surface 102*a* of the wall 102. As shown in FIG. 3, an outer seal 140 may be provided between the first housing 112 and the exterior surface 102*a* of the wall 102 of the personal watercraft 100 while the abutment surface 116 is positioned adjacent the exterior surface 102*a* of the wall 102.

As further illustrated in FIGS. 2, 2A, 2B, 4 and 6, the first housing includes a countersunk aperture 118 including a passage 120 and a countersunk recess 122 in communication with the passage 120, wherein the countersunk recess is enlarged with respect to the passage. An enlarged countersunk recess can permit a stop member, such as a locking device, to be at least partially positioned within the countersunk recess 122. Positioning the stop member at least partially within the countersunk recess can avoid interference between the stop member and the rider and/or foreign objects adjacent the watercraft. In certain exemplary embodiments, the stop member can be received substantially entirely within the countersunk recess 122 to avoid interference. For example, the stop member might be positioned within the countersunk recess such that it is flush with an outer surface 114 of the first housing 112. In particular embodiments, the stop member can comprise a locking device adapted to be engaged with an intermediate portion of the elongated flexible line. For example, as shown in one particular embodiment, a locking device 170 can be selectively received substantially entirely within the countersunk recess 122.

Figure 6:
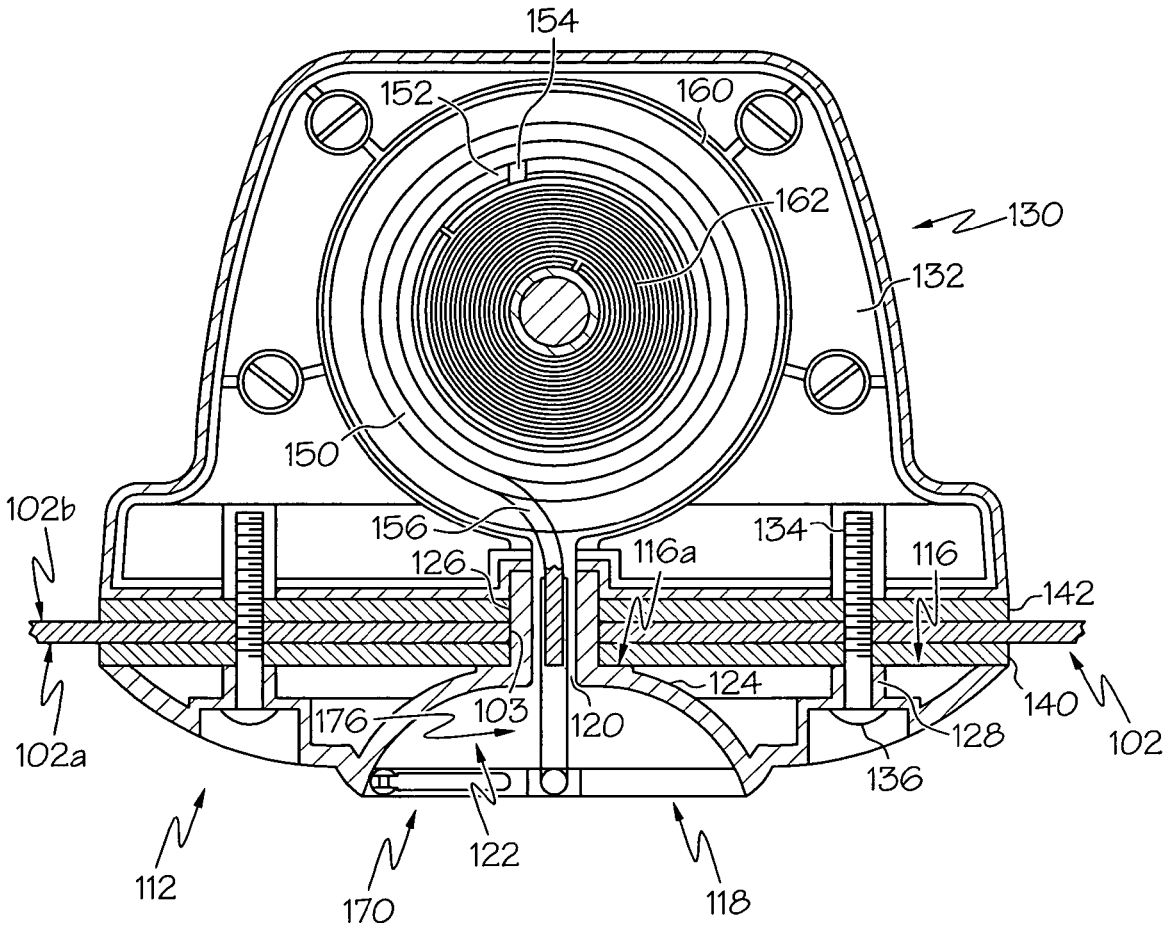
FIG. 6 is a sectional view depicting portions of the apparatus for tethering a watercraft taken along line 6—6 of FIG. 2.

As shown in FIG. 6, the first housing 112 includes a structure 124 forming the countersunk recess 122 of the countersunk aperture 118. The structure 124 can include a portion 116*a* of the abutment surface 116. The portion 116*a* of the abutment surface reduces the bearing pressure adjacent an aperture 103 in the wall 102 and also distributes stress within the first housing 112 to help prevent structural failure under high-stress concentrations. In alternative embodiments, the structure 124 of the first housing 112 might not form a portion of the abutment surface.

The first housing 112 can also include an optional collar 126 extending from the countersunk recess 122 and at least partially defining the passage 120. As shown in FIG. 6, the collar 126, if provided, extends through the wall 102, by way of the aperture 103, while the abutment surface 116 is positioned adjacent the exterior surface 102*a* of the watercraft wall 102. In exemplary embodiments, the collar 126 can protect the wall 102 and the outer and inner seals 140, 142, if provided, from an optional shank of a stop member such as a locking device. The collar 126 can also act as a guide to direct a shank to position the stop member. In certain embodiments, the shank might be keyed into the collar to angularly orient the stop member with respect to the first housing 112. Alternative embodiments might not include a collar to reduce material costs and reduce the complexity of forming the first housing. In this instance, the passage 120 might comprise a hole in the structure 124 of the first housing that forms the countersunk recess 122.

Figure 5:
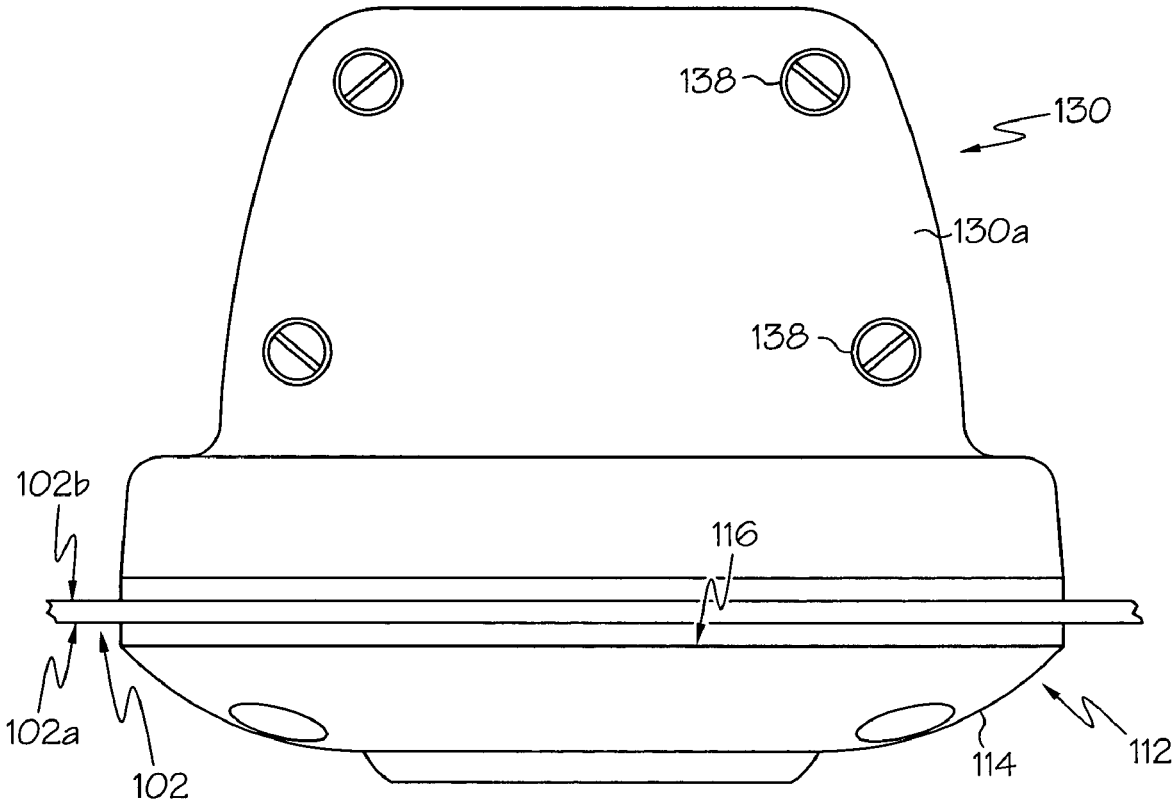
FIG. 5 is a top plan view of the apparatus for tethering a watercraft of FIG. 2.

As further illustrated in FIG. 3, the apparatus 110 further includes a second housing 130 including a first portion 130*a* adapted to be fastened to a second portion 130*b* to define an interior area 132 of the second housing 130. As shown in FIG. 5, for example, a plurality of fasteners 138 may be provided to fasten the first portion 130*a* to the second portion 130*b*. As further illustrated in FIG. 3, the second housing 130 is adapted to be mounted with respect to an interior surface 102*b* of the wall 102. As shown, an inner seal 142 may be positioned between an abutment surface of the second housing 130 and the interior surface 102*b* of the wall 102. The inner seal 142 and the outer seal 140 can comprise a wide variety of materials to provide an appropriate fluid seal. In exemplary embodiments, the inner and outer seals can comprise a closed-cell or open-cell foam rubber. It is also possible to design the seals to conform to the curvature of the watercraft wall 102. In particular embodiments, the inner and outer seals may conform to a wide range of curvatures to accommodate alternative watercraft wall types.

A portion of the wall 102 may be clamped between the first housing 112 and the second housing 130 by a plurality of fasteners 136. For example, as shown in FIG. 6, the first housing 112 includes a first fastener opening 128 and the second housing 130 includes a second threaded fastener opening 134, wherein a fastener 136 is adapted to be tightened to clamp a portion of the watercraft wall 102 between the first housing 112 and the second housing 130. Once clamped, the outer seal 140 and the inner seal 142 are effective to provide a fluid resistant housing to inhibit or prevent liquid from entering into the housing and contaminating the components therein. Additional seals may be provided about the fasteners to prevent fluid leakage through the fastener openings. Although not shown, it is contemplated that the first and second housing may be designed without the use of one or both of the inner and outer seals, wherein the housing may be tightened or connected to the watercraft wall without leakage by abutment between the first and second housings and the wall of the watercraft. In additional embodiments, fluid leakage might not be a concern. For example, interior components might be made from corrosion-resistant materials wherein fluid leakage does not necessitate a water resistant housing. Clamping a portion of the wall 102 between the first housing 112 and the second housing 130 also simplifies retrofit of existing watercraft with the apparatus. For example, the apparatus 110 may be sold separately and later installed on the wall of an existing personal watercraft by simply clamping the first and second housing with respect to one another.

Figure 4:
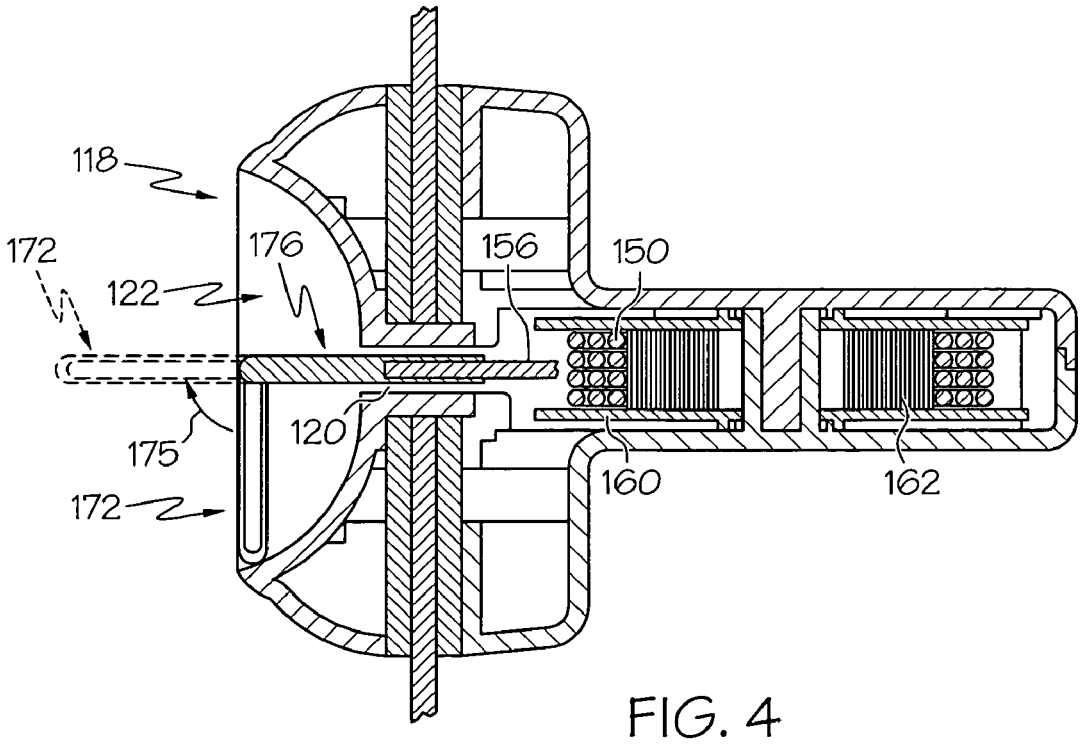
FIG. 4 is a sectional view depicting portions of the apparatus for tethering a watercraft taken along line 4—4 of FIG. 2.

Apparatus 110 for tethering a watercraft in accordance with the present invention include an elongated flexible line. Elongated flexible lines can comprise a cord, cable, rope, string, wire, strap or the like. FIGS. 4 and 6, for example, include a schematic depiction of an elongated flexible line 150. As shown in FIG. 6, the elongated flexible line 150 includes a first end portion 152 attached to a spool 160 by a bracket 154 and a second end portion 156 attached to a locking device, such as locking device 170. The spool 160 is rotatably mounted within the interior area 132 of the second housing 130 and a biasing member 162, such as a torsion spring, is provided and adapted to urge the spool 160 to automatically uptake portions of the elongated flexible line 150.

In exemplary embodiments, the biasing member 162 is adapted to urge the locking device 170 to be at least partially positioned within the countersunk recess 122 in the first housing 112. The biasing member 162 can also maintain tension in deployed portions of the elongated flexible line as shown in FIG. 1. Therefore, the biasing member may assist in positioning the personal watercraft adjacent the landing area. The biasing member may allow more line to be deployed depending on the force presented. Therefore, waves and other disturbances will not jar the personal watercraft but will be absorbed by the biasing member wherein, after the disturbance, the personal watercraft will return to its resting position adjacent the landing area. In alternative embodiments, a device may be provided to arrest the elongated flexible member to provide a fixed length of deployed line to more securely anchor the watercraft with respect to the landing.

Figure 7:
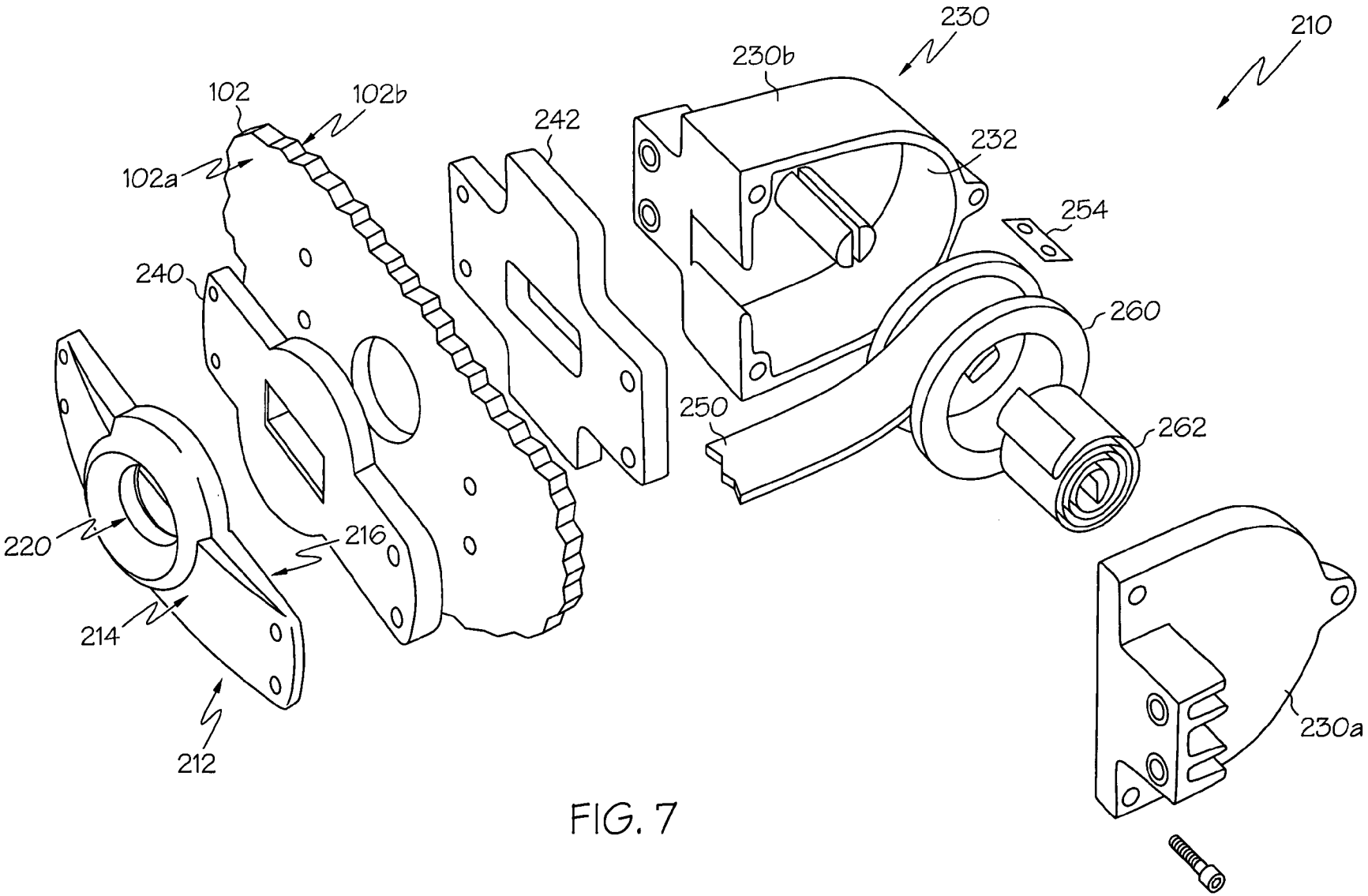
FIG. 7 is an exploded perspective view of portions of an apparatus for tethering a watercraft in accordance with another embodiment of the present invention.

FIG. 7 depicts an exploded view of portions of another embodiment of an apparatus 210 for tethering a watercraft. The apparatus is particularly designed for an elongated flexible line comprising an elongated flexible strap 250. As shown the apparatus 210 includes a first housing 212 including an outer surface 214 and an abutment surface 216 adapted to be positioned adjacent the exterior surface 102*a* of the wall 102. The first housing 212 includes a countersunk aperture 220 adapted to receive at least a portion of a locking device. The apparatus 210 further includes a second housing 230 including a first portion 230*a* adapted to be fastened to a second portion 230*b* to define an interior area 232 of the second housing 230.

The elongated flexible strap 250 includes a first end portion (not shown) for attaching to a spool 260 by a bracket 254 and a second end portion (not shown) for attaching to a locking device comprising one of the locking devices described throughout this application. The spool 260 is rotatably mounted within the interior area 232 of the second housing 230 and a biasing member 262, such as a torsion spring, is provided and adapted to urge the spool 260 to automatically uptake portions of the elongated flexible strap 250. An outer seal 240 and an inner seal 242 may also be provided to inhibit or prevent fluid from leaking into the interior area 232 of the second housing 230.

Apparatus in accordance with concepts of the present invention may comprise a kit of components for selling separately from the watercraft. The kit includes a first and second housing as described above. The kit may also include an optional template to facilitate formation of predrilled holes in the watercraft wall. For example, the template might comprise a sticker or magnet adapted to be mounted to the watercraft wall 102. Once mounted, guide holes or markings on the template indicate where the hole 103 and/or the holes for the fasteners 136 should be drilled. Once the necessary holes are drilled, the template may be removed. Alternatively, the template may be left in place and subsequently covered by the apparatus. The elongated flexible line is threaded through the corresponding aperture in the inner seal and the aperture 103 in the watercraft wall 102. The second housing and the inner seal are then positioned adjacent the interior surface 102*b* of the watercraft wall 102. The elongated flexible line is then threaded through the corresponding aperture in the outer seal and the passage of the countersunk aperture. Next, the stop member, such as the locking device, is fastened to the corresponding end portion of the elongated flexible line. The first housing and the outer seal are then placed adjacent the exterior surface 102*a*. Once the fastening apertures of the first and second housings are aligned with the corresponding apertures in the watercraft wall 102, the fasteners 136 are used to clamp a portion of the watercraft wall 102 between the first and second housings. The kit can further include a plurality of alternative first housings 112 having alternative features such as alternative shapes, colors, or the like, to allow selection by the installer of a customized housing considered most appropriate by the installer. Still further, each kit might include a single alternative first housing while including the same second housing to allow preselection of a particular kit for a unique watercraft. Providing a single first housing also reduces the overall cost of the kit since excess first housings provided in the same kit are eliminated. Moreover, providing a common second housing reduces inventory costs necessary to form individual kit packages. Providing a common second housing with alternative first housings also allows each individual kit to accommodate a wide range of watercrafts while providing a common second housing that is adapted to cooperate with each alternative first housing.

Figure 2B:
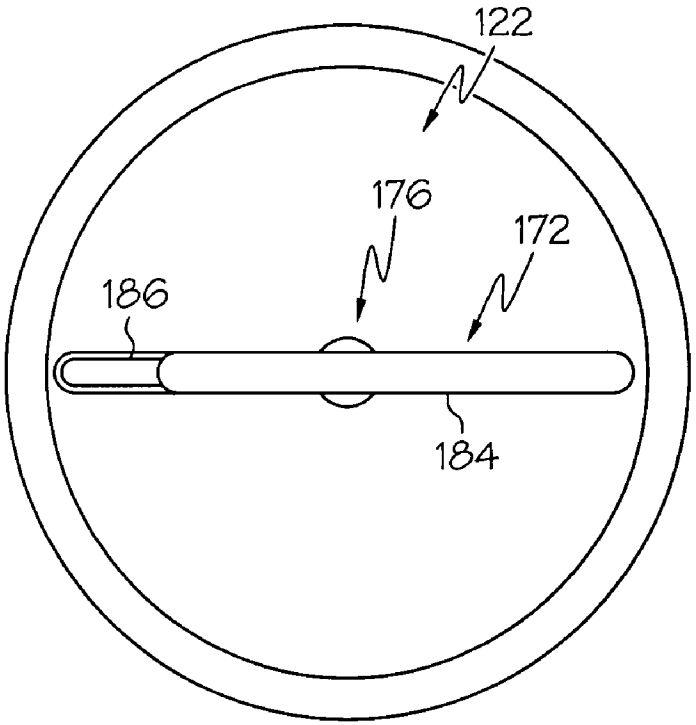
FIG. 2B is a front elevational view of a locking device of FIG. 2 in a second position.
Figure 2A:
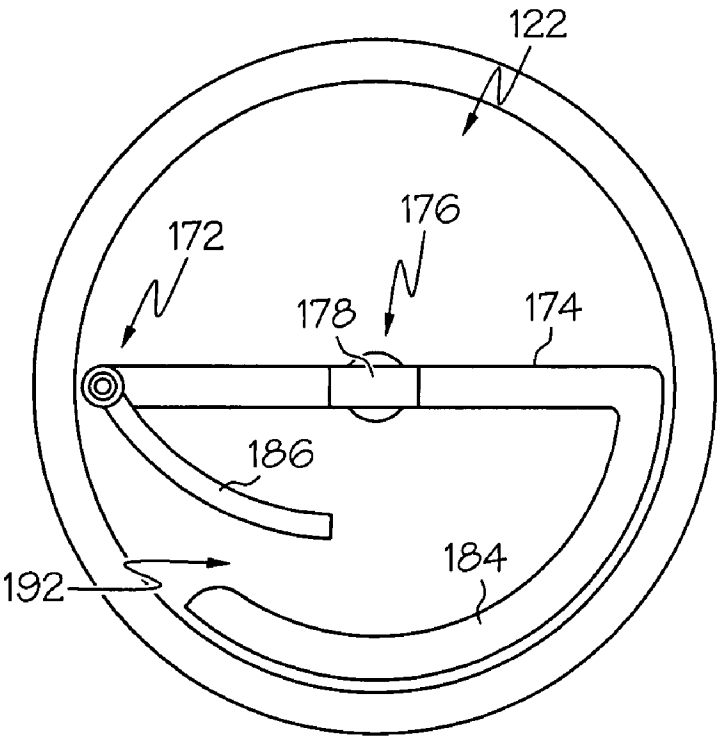
FIG. 2A is a front elevational view of a locking device of FIG. 2 in a first position.

A wide variety of locking devices may be used in accordance with the embodiments of the present invention described above. A first embodiment of a locking device 170 is illustrated in the embodiment of FIGS. 2–6 but might also be incorporated in the embodiment illustrated in FIG. 7. The locking device 170 includes a D-shaped engagement ring 172 adapted to substantially encircle an intermediate portion of the elongated flexible line 150 to form an adjustable mooring loop having an adjustable size. The D-shaped ring includes a pivot side 174 adapted to pivot in the direction of the arrow 175 about a pivot end 178 of a shank 176 attached to the second end portion 156 of the elongated flexible line 150. Accordingly, the D-shaped engagement ring 172 is rotatably attached to the shank 176 such that the D-shaped engagement ring may be pivoted between a deployed position, as shown in FIG. 2B and in broken lines in FIG. 4, wherein a portion of the D-shaped engagement ring extends outside of the countersunk recess 122 and a storage position wherein the D-shaped engagement ring 172 is received substantially entirely within the countersunk recess 122 as shown in FIG. 2. Forming the ring of the locking member 170 in a "D-shape" allows the ring to be received within a countersunk recess having a circular opening as best illustrated in FIGS. 2, 2A and 2B. Although not required, the D-shaped engagement ring 172 may include another biasing member, such as a torsion spring, to urge the engagement ring 172 to pivot to the storage position to avoid interference with the rider and/or foreign objects in use. The D-shaped engagement ring 172 can also act as a pull handle to allow the rider to easily deploy portions of the elongated flexible line.

The D-shaped ring further includes an arcuate side 182 including a first rigid portion 184 attached to the pivot side 174 and a second pivot portion 186 pivotally attached at pivot point 190 to the pivot side 174. A biasing member, such as a torsion spring, is adapted to bias the second pivot portion 186 against the first rigid portion 184 to the relative position illustrated in FIG. 2. The second pivot portion 186 can also be pivoted against the force of the biasing member to pivot the second portion 186 about pivot point 190 in the direction of the arrow 188 from the position illustrated in FIG. 2 to the position illustrated in FIG. 2A wherein an intermediate portion of the elongated flexible line 150 may be inserted into a gap 192 between the second pivot portion 186 and the first rigid portion 184. Once inserted, the second pivot portion 186 may be released such that the biasing member again positions the second pivot portion 186 against the first rigid portion 184 to the relative position illustrated in FIG. 2 to trap an intermediate portion of the elongated flexible line within an encircled interior space 194. To release the intermediate portion of the elongated flexible line, the second pivot portion 186 may be pivoted back against the force of the biasing member to recreate the gap 192 to release the intermediate portion of the elongated flexible member. Accordingly, the locking device 170 may releasably lock an intermediate portion of the elongated flexible member to form a mooring loop. As the intermediate portion may freely travel along its axis within the encircled interior space 194 substantially defined by the D-shaped engagement ring, the mooring loop is also adjustable. Providing an adjustable mooring loop is beneficial to allow the mooring loop to conform to a wide variety of mooring structures with minimal use of line. For example, an adjustable mooring loop provided with the locking device 170 can be used to attach to a various trees having different diameters. Once the intermediate portion is attached with the locking device 170, the bias of the biasing member 162 of the apparatus 110 automatically uptakes excess portions of the elongated flexible line 150 to reduce the size of the mooring loop 180 depending on the diameter of the tree while maintaining a level of tension in deployed portions of the elongated flexible line to position the watercraft adjacent the landing area.

Figure 8A:
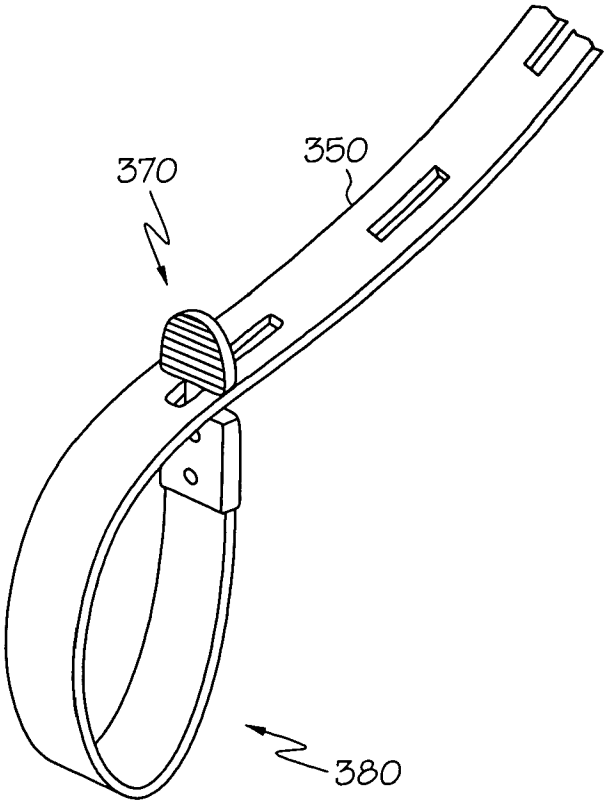
FIG. 8A depicts a perspective view of an elongated flexible line and a locking device of FIG. 8 wherein the locking device is interlocked with an intermediate portion of the elongated flexible line to form a mooring loop having a predetermined size.
Figure 8:
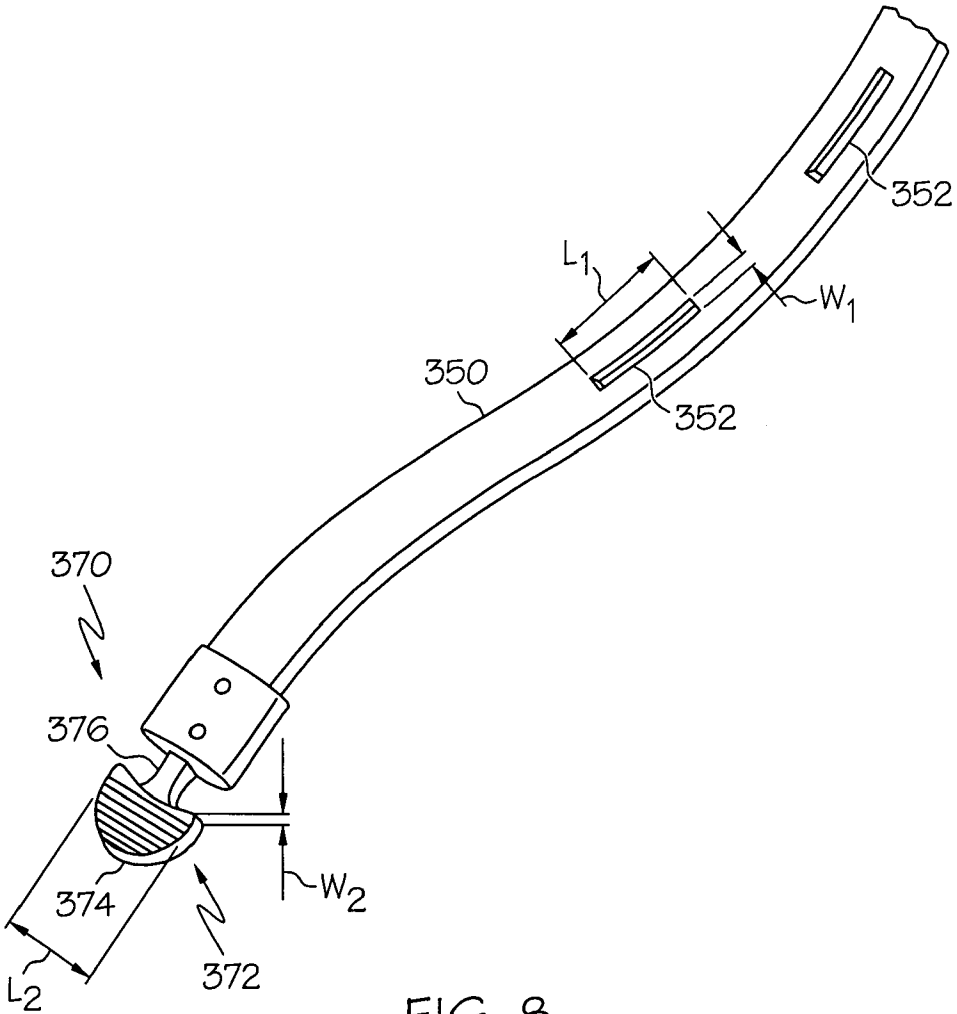
FIG. 8 depicts a perspective view of an elongated flexible line and a locking device in accordance with a second embodiment of the present invention.

Embodiments of the present invention might also include an elongated flexible line comprising an elongated flexible strap 350 as illustrated in FIG. 8 with a locking device comprising an interlock device 370 in accordance with a second embodiment of the present invention. As shown, the interlock device 370 is adapted to interlock with an intermediate portion of the elongated flexible line to form a mooring loop 380 having a predetermined size. Providing a mooring loop 380 with a predetermined size might be desirable to prevent tightening of the mooring loop 380 about certain mooring structures as deployed portions of the elongated flexible line are placed under tension.

As shown in FIGS. 8 and 8A the elongated flexible strap can include a plurality of apertures 352 wherein the interlock device 370 is adapted to releasably interlock with a selected one of the apertures depending on the selected predetermined size desired for the mooring loop 380. In particular examples, flexible straps of exemplary embodiments might include apertures that are reinforced, for example, with stitching, grommets or the like. As further illustrated in FIGS. 8 and 8A, exemplary embodiments might include a key aperture 352 and the interlock device 370 includes a key portion 372 adapted to be inserted into a selected one of the key apertures 352 and rotated to interlock the interlock device 370 with the selected one of the key apertures 352. In the particular illustrated embodiment, the key portion 372 of the interlock device 370 includes a substantially T-shaped portion including dimensions adapted to be received by the key aperture 352 and interlocked with the key aperture 352. As shown, the T-shaped portion includes an elongated locking member 374 and a neck 376. The neck 376 is dimensioned such that it may be rotated when positioned in the key aperture 352. Each key aperture 352 can include an elongated slot including a width $W_1$ and an elongated length $L_1$ that is longer than the width $W_1$. The elongated locking member 374 includes a width $W_2$ that is less than or about equal to the width $W_1$ of the elongated slot. The elongated locking member 374 of the key portion 372 also includes an elongated length $L_2$ that is greater than the width $W_2$ of the elongated locking member 374 and less than or about equal to the elongated length $L_1$ of the elongated slot. Therefore, the elongated locking member 374 may be inserted into the elongated slot of the key aperture 352 by aligning the elongated lengths and the widths of the elongated locking member 374 and the elongated slot of the key aperture 352. Once inserted, the neck 376 is positioned within the key aperture 352. Next, the elongated locking member 374 is rotated 90° to the position illustrated in FIG. 8A wherein the interlock device 370 is interlocked with the intermediate portion of the elongated flexible strap 350.

Figure 9:
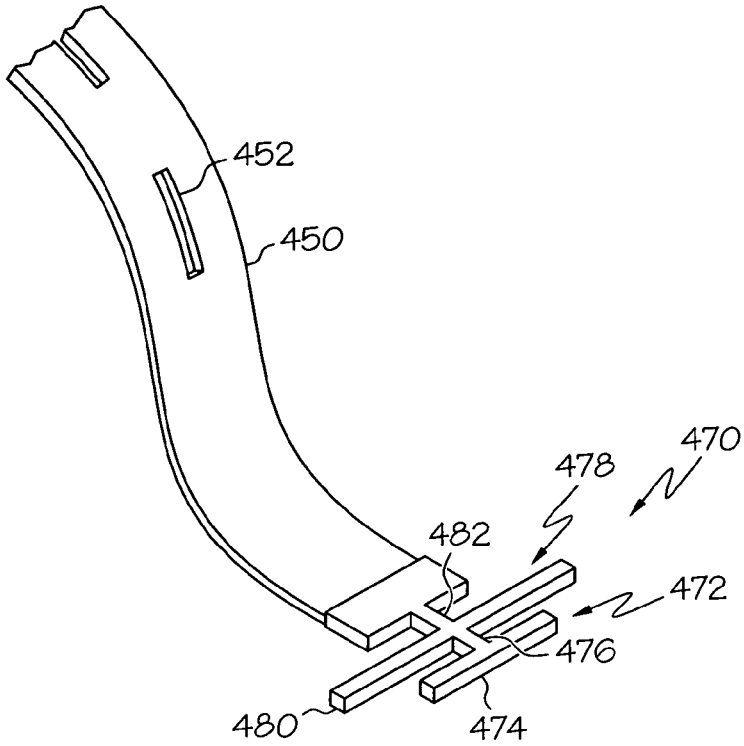
FIG. 9 depicts a perspective view of an elongated flexible line and a locking device in accordance with a third embodiment of the present invention.

Embodiments of the present invention might also include an elongated flexible strap 450 as illustrated in FIG. 9 with a locking device comprising an interlock device 470 in accordance with a third embodiment of the present invention. As shown, the interlock device 470 is adapted to interlock with an intermediate portion of the elongated flexible strap to form a mooring loop having a predetermined size. The interlock device 470 includes a key portion 472 including an elongated locking member 474 and a neck 476. The elongated locking member 374 is adapted to be received by a selected one of a plurality of apertures 452 for interlocking with one of the apertures as described with respect to the embodiment of FIGS. 8 and 8A described above. The interlock device 470 can also include a second T-shaped portion formed from an elongated member 480 and another neck 482. The elongated member 480 might be longer than the first elongated locking member 374 to prevent the elongated member 480 from entering into the apertures 452. Thus, the elongated member 480 may comprise a stop that limits insertion of the interlock device 470 within the aperture 452 for proper alignment. Still further, another key portion 478 may comprise the elongated member 480 and the neck 482 wherein the elongated member 480 forms a second elongated locking member adapted to interlock with other mooring structures. For example, the key portion 478 of the interlock device 470 may be inserted in the slot defined between boards in a dock and thereafter rotated to interlock the interlock device 470 to the boards of a dock. In such an interlocked condition, the neck 482 can be positioned between the boards while the elongated member 480 lies against one side of the boards. While the elongated locking member 474 is illustrated as an elongated bar, it is contemplated that the elongated locking member 474 might comprise a tab, similar to the elongated locking member 374 illustrated in FIGS. 8 and 8A. Providing a tab may provide an easier gripping structure for one deploying the tethering line from the tethering apparatus. Similarly, while the elongated locking member 374 illustrated in FIGS. 8 and 8A is shown as a tab, it is contemplated that the tab might comprise an elongated bar, similar to the elongated locking member 474 illustrated in FIG. 9. Therefore, it is possible to provide an interlock device with a single T-shaped portion formed from a neck and an elongated bar, similar to the neck 476 and elongated bar 474 illustrated in FIG. 9. Providing an elongated bar may reduce the size of the first housing necessary to form a recess deep enough to receive the entire elongated bar.

Figure 10:
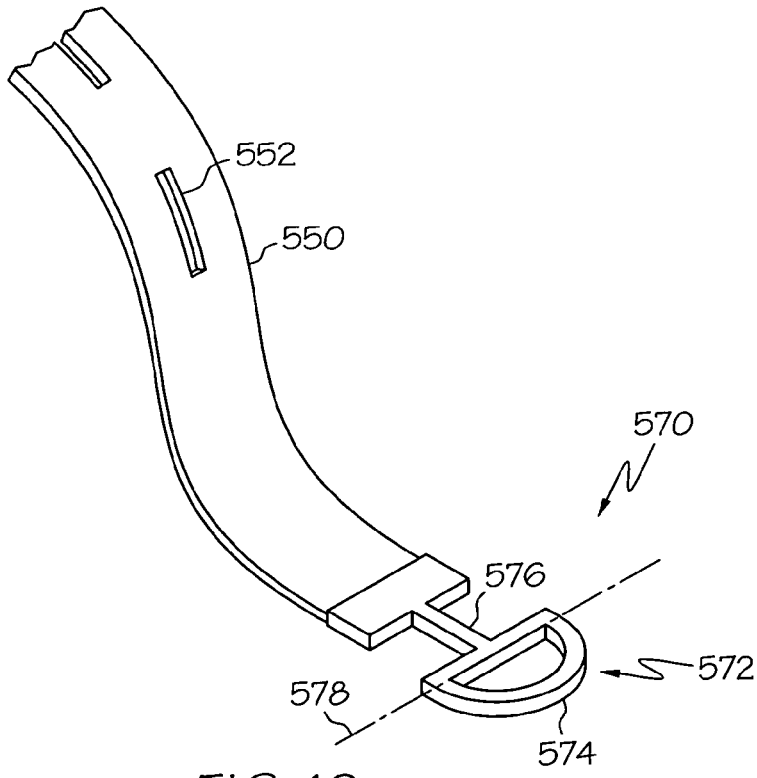
FIG. 10 depicts a perspective view of an elongated flexible line and a locking device in accordance with a fourth embodiment of the present invention.

Embodiments of the present invention might also include an elongated flexible strap 550 as illustrated in FIG. 10 with a locking device comprising an interlock device 570 in accordance with a fourth embodiment of the present invention. As shown, the interlock device 570 is adapted to interlock with an intermediate portion of the elongated flexible strap to form a mooring loop having a predetermined size. The interlock device 570 includes a key portion 572 including an elongated locking member 574 and a neck 576. The elongated locking member 574 is adapted to be received by a selected one of a plurality of apertures 552 for interlocking with one of the apertures as described with respect to the embodiment of FIGS. 8 and 8A described above. In addition, the elongated locking member 574 may pivot with respect to the neck 576 about pivot axis 578. Therefore, the locking member 574 may be rotated between a stored and deployed position with respect to the countersunk recess in a manner similar as discussed with respect to the locking member 170 depicted in FIGS. 2, 2B and 4 above.

Figure 11:
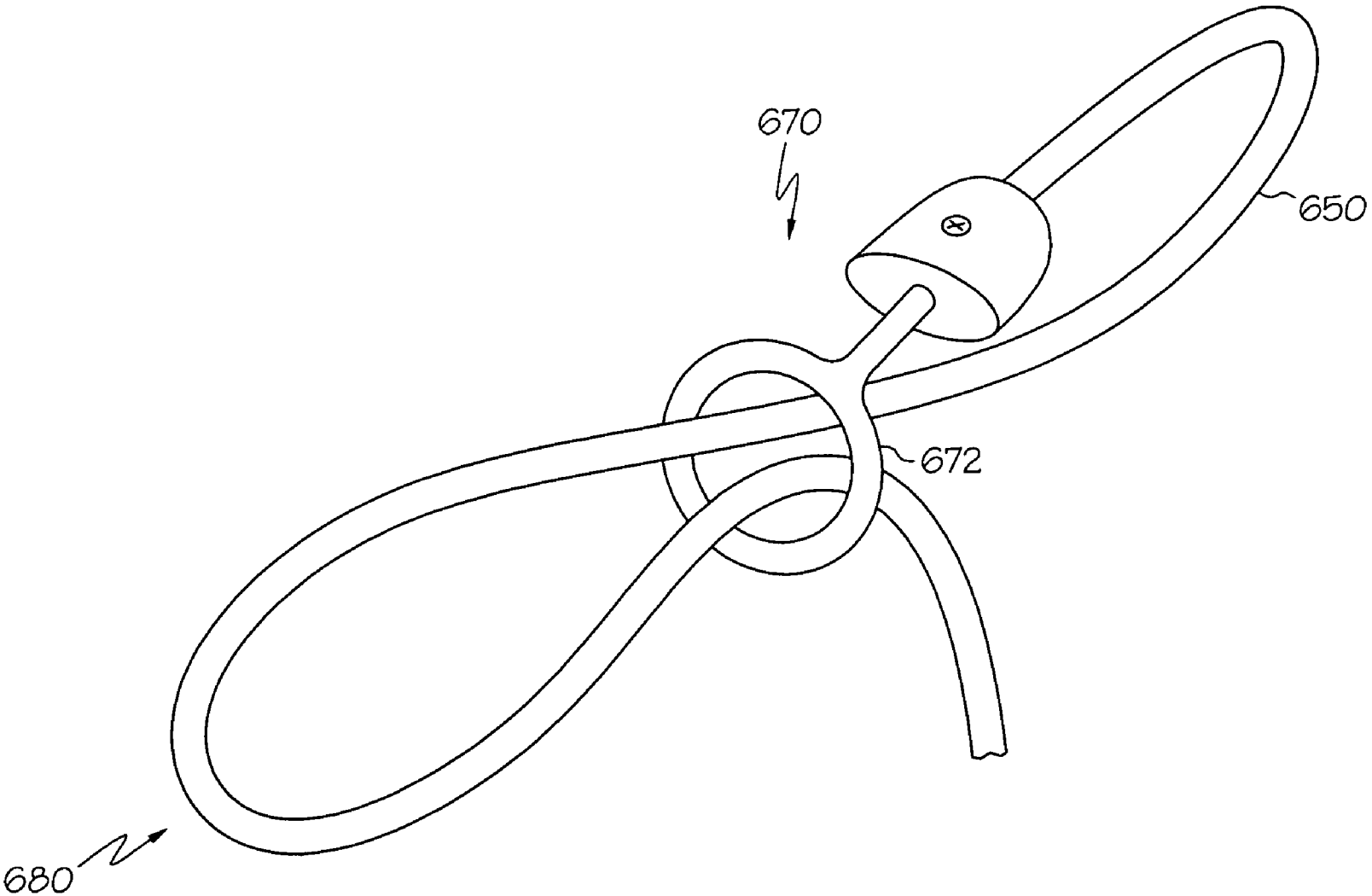
FIG. 11 depicts a perspective view of an elongated flexible line and a locking device in accordance with a fifth embodiment of the present invention.
Figure 13:
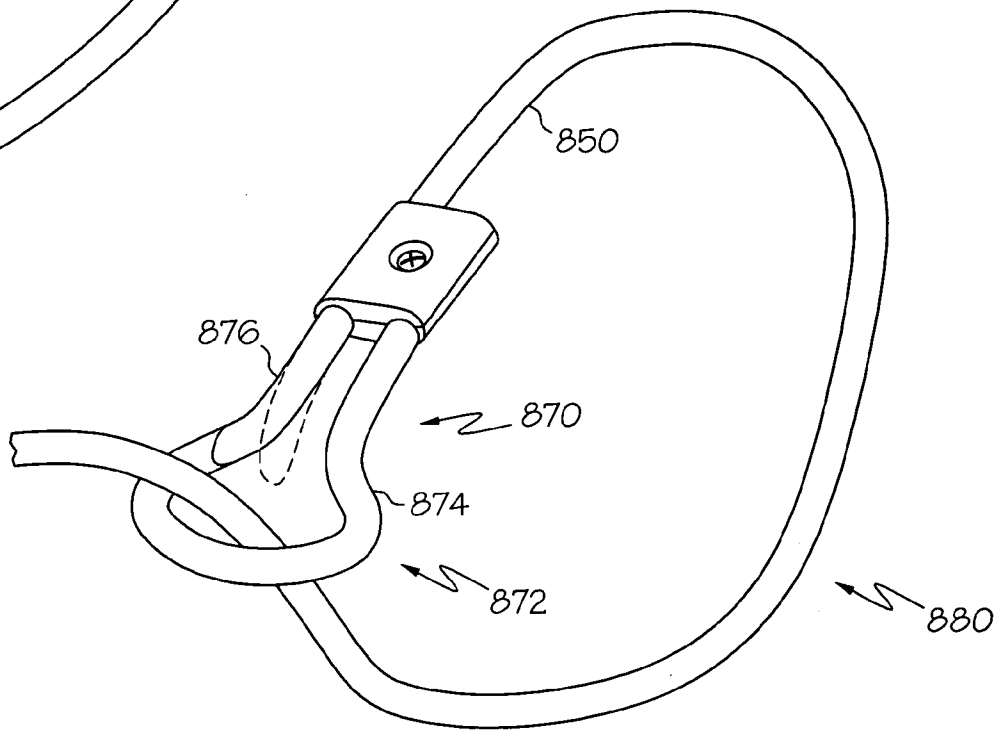
FIG. 13 depicts a perspective view of an elongated flexible line and a locking device in accordance with a seventh embodiment of the present invention.
Figure 12:
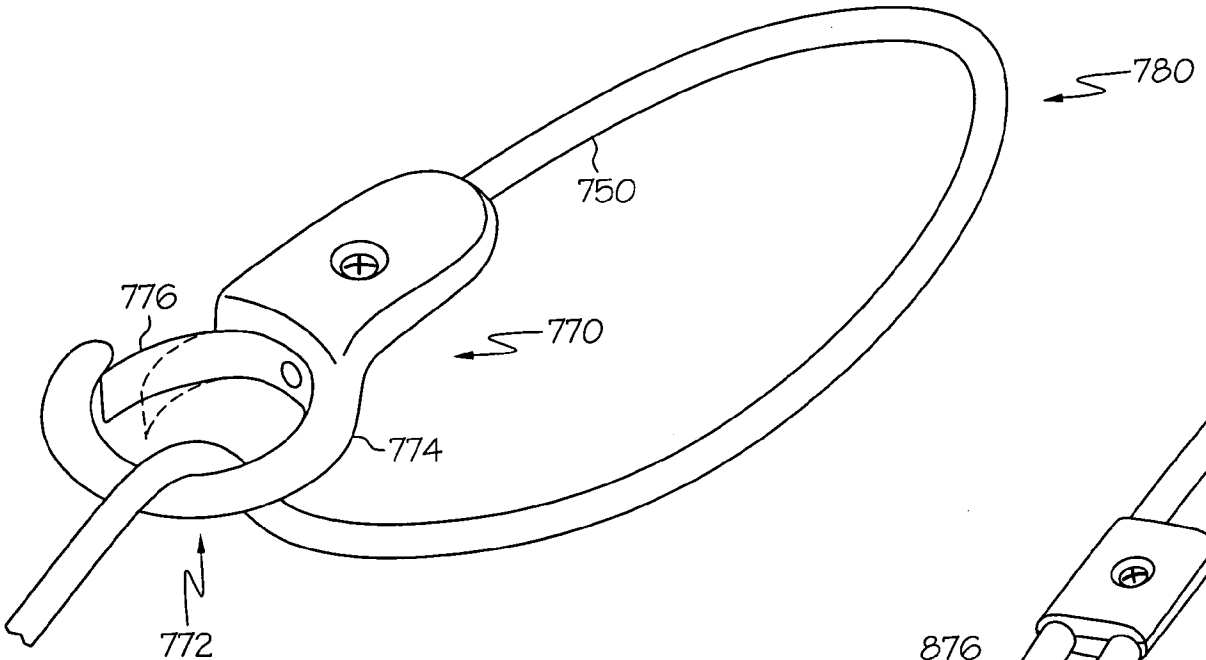
FIG. 12 depicts a perspective view of an elongated flexible line and a locking device in accordance with a sixth embodiment of the present invention.

FIGS. 11–13 depict further exemplary embodiments of locking devices including an engagement ring adapted to substantially encircle an intermediate portion of an elongated flexible line to form an adjustable mooring loop having an adjustable size. For example, embodiments of the present invention might also include an elongated flexible line 650 as illustrated in FIG. 11 with a locking device 670 in accordance with a fifth embodiment of the present invention. The locking device 670 includes an integrally closed engagement ring 672. An intermediate portion of the elongated flexible line may be threaded through the closed engagement ring 672 to form an adjustable mooring loop 680 having an adjustable size. As shown, the locking device 670 does not include moving parts, thereby reducing failure points.

Embodiments of the present invention might also include an elongated flexible line 750 as illustrated in FIG. 12 with a locking device 770 in accordance with a sixth embodiment of the present invention. As shown, the locking device 770 includes an engagement ring 772 having an overall substantially circular shape that may be selectively opened to receive an intermediate portion of the elongated flexible line 750 to form an adjustable mooring loop 780. As shown, the engagement ring 772 includes an arcuate hook portion 774 and a spring portion 776 adapted to be biased to the closed position. The spring portion 776 may be temporarily bent backward, as shown in broken lines in FIG. 12, to form a gap to allow insertion of the intermediate portion of the elongated flexible line 750. Once inserted, the spring portion 776 is released and thereafter biased back in place to close the engagement ring 772. Similarly, embodiments of the present invention might also include an elongated flexible line 850 as illustrated in FIG. 13 with a locking device 870 in accordance with a seventh embodiment of the present invention. As shown, the locking device 870 includes an engagement ring 872 having an elongated shape that may be selectively opened to receive an intermediate portion of the elongated flexible line 850 to form an adjustable mooring loop 880. As shown, the engagement ring 872 includes a hook portion 874 and a biased portion 876 that may comprise a material that allows resilient bending of the biased portion 876. The biased portion 876 can be temporarily bent backward, as shown in broken lines in FIG. 13, to form a gap to allow insertion of the intermediate portion of the elongated flexible line 850. Once inserted, the biased portion 876 is biased back in place to close the engagement ring 872.

Providing a locking device with an engagement ring that can be selectively opened and closed (e.g., see locking devices 170, 770, 870) allows forming an adjustable mooring loop for mooring to object by wrapping around the object rather than placing over an object as would be required by the locking device illustrated in FIG. 11. If the mooring structure comprises a tree, it might be easier to wrap the elongated flexible line around the trunk of the tree and thereafter form the adjustable mooring loop in accordance with the locking devices 170, 770, 870 rather than first forming the adjustable mooring loop and attempting to place the loop over the tree in accordance with locking device 670.

While certain locking devices 170, 770, 870 are described as forming adjustable mooring loops, it is also possible to use such devices as interlock devices to interlock with portions of the elongated flexible line. For example, the elongated flexible line could comprise an elongated flexible strap with a plurality of apertures, wherein the locking devices 170, 770, 870 can be selectively hooked into one of the apertures to interlock the locking devices 170, 770, 870 with an intermediate portion of the elongated flexible strap to form a mooring loop having a predetermined size.

From the above description of the invention, those skilled in the art will perceive improvements, changes and modifications. Such improvements, changes and modifications within the skill of the art are intended to be covered by the appended claims.

What is claimed is:

1. An apparatus for tethering a watercraft having a wall with an exterior surface and an interior surface, the apparatus comprising:

a first housing adapted to be mounted with respect to the exterior surface of the watercraft, the first housing including an outer surface and an abutment surface adapted to be positioned adjacent the exterior surface of the watercraft, the first housing further comprising a countersunk aperture including a passage and a countersunk recess in communication with the passage, wherein the countersunk recess is enlarged with respect to the passage and wherein a structure of the first housing forms the countersunk recess and includes at least a portion of the abutment surface, and further wherein the abutment surface and a periphery of the first housing are configured to be positioned adjacent one side of a substantially continuous exterior surface of a watercraft with the abutment surface positioned between the countersunk recess and the one side of the substantially continuous exterior surface;

a second housing including an interior area, wherein the second housing is adapted to be mounted with respect to the interior surface of the watercraft;

an elongated flexible line threaded through the passage of the first housing and including a first end portion and a second end portion;

a spool rotatably mounted within the interior area of the second housing, the first end portion of the elongated flexible line being attached to the spool;

a biasing member adapted to urge the spool to automatically uptake portions of the elongated flexible line; and a locking device attached to the second end portion of the elongated flexible line and at least partially positioned within the countersunk recess of the countersunk aperture, the locking device and the passage of the countersunk aperture being configured to limit automatic uptake of portions of the elongated flexible line, wherein the biasing member is adapted to urge the locking device to be at least partially positioned within the countersunk recess, and wherein the locking device is adapted to be pulled from the countersunk recess and thereafter engaged with an intermediate portion of the elongated flexible line to form a mooring loop.

2. The apparatus of claim 1, wherein the first housing includes a collar extending from the countersunk recess and at least partially defining the passage, wherein the collar is adapted to extend through the wall of the watercraft while the abutment surface is positioned adjacent the exterior surface of the watercraft.

3. The apparatus of claim 1, wherein the first housing includes a first fastener opening and the second housing includes a second fastener opening, and the apparatus further comprises a fastener extending through the first fastener opening and threaded into the second fastener opening, wherein the fastener is adapted to be tightened to clamp a portion of the watercraft wall between the first housing and the second housing.

4. The apparatus of claim 1, further comprising at least one seal positioned between the first housing and the second housing.

5. The apparatus of claim 4, wherein the at least one seal comprises an outer seal adapted to be positioned between the exterior surface of the watercraft wall and the abutment surface of the first housing and an inner seal adapted to be positioned between the interior surface of the watercraft wall and second housing.

6. The apparatus of claim 1, wherein the locking device comprises an interlock device adapted to interlock with the intermediate portion of the elongated flexible line to form the mooring loop having a predetermined size.

7. The apparatus of claim 6, wherein the elongated flexible line comprises an elongated flexible strap including a plurality of apertures, wherein the interlock device is adapted to releasably interlock with a selected one of the apertures.

8. The apparatus of claim 7, wherein the plurality of apertures each comprise a key aperture and the interlock device includes a key portion adapted to be inserted into a selected one of the key apertures and rotated to interlock the interlock device with the selected one of the key apertures.

9. The apparatus of claim 8, wherein the key portion of the interlock device includes a substantially T-shaped portion.

10. The apparatus of claim 9, wherein the interlock device includes a second substantially T-shaped portion.

11. The apparatus of claim 8, wherein the key aperture includes an elongated slot including a width and a length that is longer than the width, and the key portion of the interlock device includes an elongated locking member including a width less than or about equal to the width of the elongated slot, and the elongated locking member further including an elongated length greater than the width of the elongated locking member and less than or about equal to the elongated length of the elongated slot.

12. The apparatus of claim 1, wherein the locking device comprises an engagement ring adapted to substantially encircle the intermediate portion of the elongated flexible line to form an adjustable mooring loop having an adjustable size.

13. The apparatus of claim 12, wherein the locking device comprises a D-shaped engagement ring.

14. The apparatus of claim 13, wherein the D-shaped engagement ring is adapted to be received substantially entirely within the countersunk recess.

15. The apparatus of claim 14, wherein the locking device includes a shank attached to the second portion of the elongated flexible line and the D-shaped engagement ring is rotatably attached to the shank such that the D-shaped engagement ring may be pivoted between a deployed position wherein a portion of the D-shaped engagement ring extends outside of the countersunk recess and a storage position wherein the D-shaped engagement ring is received substantially entirely within the countersunk recess.

16. An apparatus for tethering a watercraft having a wall with an exterior surface and an interior surface, the apparatus comprising:

a first housing adapted to be mounted with respect to the exterior surface of the watercraft, the first housing including an outer surface and an abutment surface adapted to be positioned adjacent the exterior surface of the watercraft, the first housing further comprising a countersunk aperture including a passage and a countersunk recess enlarged with respect to the passage and in communication with the passage, a structure of the first housing forms the countersunk recess and includes at least a portion of the abutment surface, wherein the abutment surface and a periphery of the first housing are configured to be positioned adjacent one side of a substantially continuous exterior surface of a watercraft with the abutment surface positioned between the countersunk recess and the one side of the substantially continuous exterior surface;

a second housing including an interior area, wherein the second housing is adapted to be mounted with respect to the interior surface of the watercraft;

an elongated flexible line threaded through the passage of the first housing and including a first end portion and a second end portion;

a spool rotatably mounted within the interior area of the second housing, the first end portion of the elongated flexible line being attached to the spool;

a biasing member adapted to urge the spool to automatically uptake portions of the elongated flexible line; and a stop member attached to the second end portion of the elongated flexible line and at least partially positioned within the countersunk recess of the countersunk aperture, the stop member and the passage of the countersunk aperture being configured to limit automatic uptake of portions of the elongated flexible line, wherein the biasing member is adapted to urge the stop member to be at least partially positioned within the countersunk recess.

17. The apparatus of claim 16, wherein the first housing includes a collar extending from the countersunk recess and at least partially defining the passage, wherein the collar is adapted to extend through the wall of the watercraft while the abutment surface is positioned adjacent the exterior surface of the watercraft.

18. The apparatus of claim 16, wherein the stop member comprises a locking device adapted to be engaged with an intermediate portion of the elongated flexible line.

19. The apparatus of claim 16, wherein the first housing includes a first fastener opening and the second housing includes a second fastener opening, and the apparatus further comprises a fastener extending through the first fastener opening and threaded into the second fastener opening, wherein the fastener is adapted to be tightened to clamp a portion of the watercraft wall between the first housing and the second housing.

20. The apparatus of claim 16, further comprising at least one seal positioned between the first housing and the second housing.

21. The apparatus of claim 20, wherein the at least one seal comprises an outer seal adapted to be positioned between the exterior surface of the watercraft wall and the abutment surface of the first housing and an inner seal adapted to be positioned between the interior surface of the watercraft wall and second housing.

22. A watercraft including the apparatus of claim 16, wherein the watercraft includes a substantially continuous exterior surface and an interior surface opposed to the exterior surface, the first housing of the apparatus is mounted with respect to the substantially continuous exterior surface such that the abutment surface and the periphery of the first housing is positioned adjacent one side of the substantially continuous exterior surface of the watercraft, and the second housing of the apparatus is mounted with respect to the interior surface of the watercraft.

23. An apparatus for tethering a watercraft comprising:

a first housing including a hollow interior area opening in a first direction, an abutment surface facing in the first direction, a periphery circumscribing the abutment surface and the opening of the hollow interior area, and a passage circumscribed by the abutment surface, wherein the abutment surface and the periphery of the housing are configured to be positioned adjacent one side of a substantially continuous exterior surface of a watercraft;

a second housing including an interior area, wherein the second housing is adapted to be mounted with respect to an interior surface of a watercraft;

an elongated flexible line including a first end and a second end;

a spool rotatably mounted within the interior area of the second housing, the first end of the elongated flexible line being attached to the spool;

a biasing member adapted to urge the spool to automatically uptake portions of the elongated flexible line; and a stop member attached to the second end of the elongated flexible line, wherein the stop member and the passage are configured to limit uptake of portions of the elongated flexible line, wherein the stop member may be pulled to pull portions of the elongated flexible line through the passage of the first housing.

* * * * *